US006860582B2

(12) United States Patent
Vega et al.

(10) Patent No.: US 6,860,582 B2
(45) Date of Patent: Mar. 1, 2005

(54) INK RECEIVING APPARATUS AND METHOD

(75) Inventors: Ramon Vega, Barcelona (ES); Joan Martinez, Barcelona (ES); Salvador Sanchez, Sabadell (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/845,062

(22) Filed: Apr. 27, 2001

(65) Prior Publication Data

US 2002/0158941 A1 Oct. 31, 2002

(51) Int. Cl.[7] ..... B41J 2/165

(52) U.S. Cl. ..... 347/35; 347/22; 347/32; 347/33; 347/36

(58) Field of Search ..... 347/35, 36, 32, 347/33, 22

(56) References Cited

U.S. PATENT DOCUMENTS 5,563,639 A * 10/1996 Cameron et al. ..... 347/34
5,896,145 A * 4/1999 Osborne et al. ..... 347/33
6,318,838 B1 * 11/2001 Anderson et al. ..... 347/36

* cited by examiner

*Primary Examiner*—Stephen D. Meier
*Assistant Examiner*—Ly T Tran
(74) *Attorney, Agent, or Firm*—Peter Lippman

(57) ABSTRACT

An ink jet device comprising at least one print head arranged to eject ink drops in a spitting operation and a spittoon arranged to store said ejected ink, the device further comprising a temporary spittoon arranged to move between first and second positions, in said first position said temporary spittoon being located in close proximity to a nozzle plate of said printhead and arranged such that ejected ink drops are directed onto a surface of said temporary spittoon, in said second position said temporary spittoon being located sufficiently distant from said nozzle plate to allow a capping or wiping operation to be performed and arranged to transfer said ink to said spittoon.

26 Claims, 6 Drawing Sheets

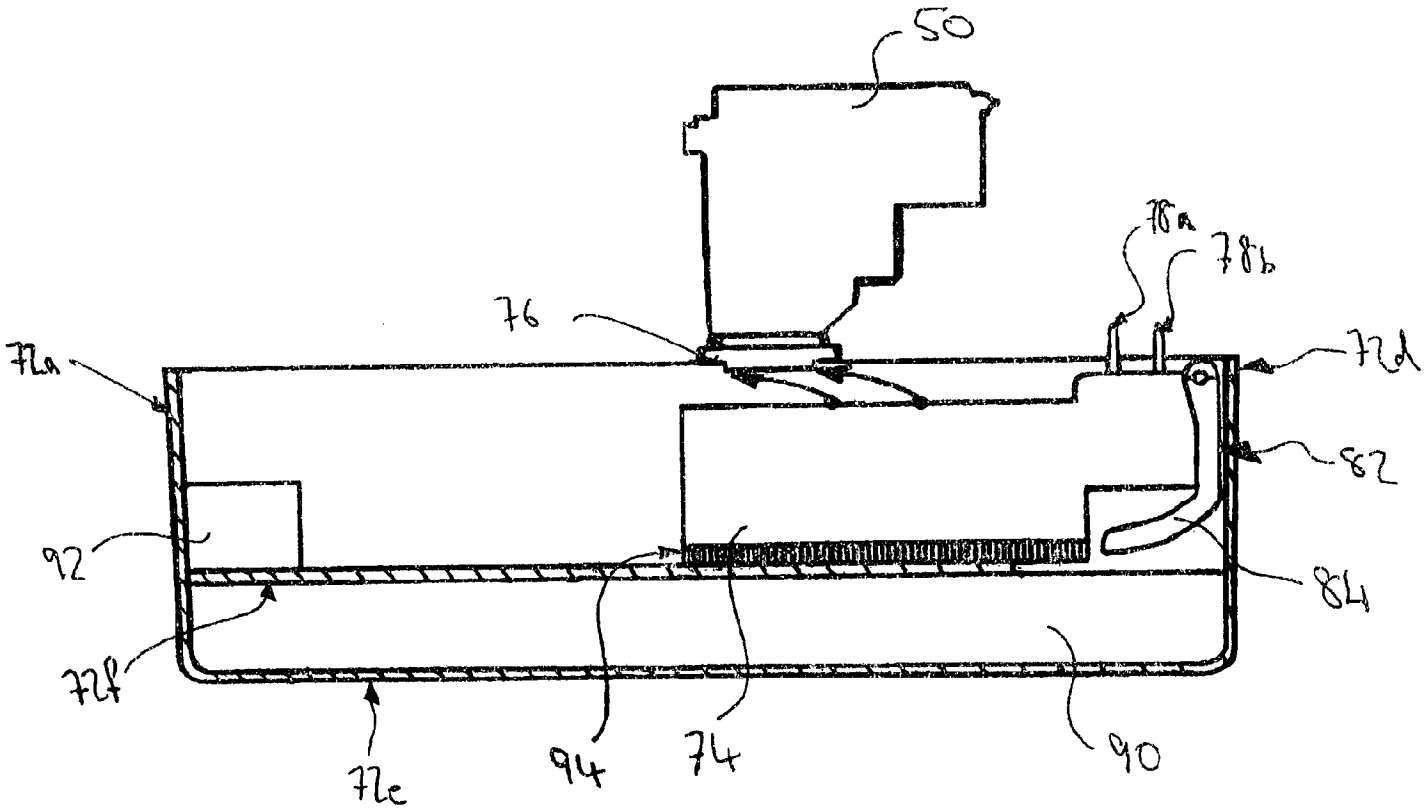
76
78
78a
78b
78c
78d
78e
78f
78g
78h
78i
78j
78k
78l
78m
78n
78o
78p
78q
78r
78s
78t
78u
78v
78w
78x
78y
78z
78aa
78ab
78ac
78ad
78ae
78af
78ag
78ah
78ai
78aj
78ak
78al
78am
78an
78ao
78ap
78aq
78ar
78as
78at
78au
78av
78aw
78ax
78ay
78az
78ba
78bb
78bc
78bd
78be
78bf
78bg
78bh
78bi
78bj
78bk
78bl
78bm
78bn
78bo
78bp
78bq
78br
78bs
78bt
78bu
78bv
78bw
78bx
78by
78bz
78ca
78cb
78cc
78cd
78ce
78cf
78cg
78ch
78ci
78cj
78ck
78cl
78cm
78cn
78co
78cp
78cq
78cr
78cs
78ct
78cu
78cv
78cw
78cx
78cy
78cz
78da
78db
78dc
78dd
78de
78df
78dg
78dh
78di
78dj
78dk
78dl
78dm
78dn
78do
78dp
78dq
78dr
78ds
78dt
78du
78dv
78dw
78dx
78dy
78dz
78ea
78eb
78ec
78ed
78ee
78ef
78eg
78eh
78ei
78ej
78ek
78el
78em
78en
78eo
78ep
78eq
78er
78es
78et
78eu
78ev
78ew
78ex
78ey
78ez
78fa
78fb
78fc
78fd
78fe
78ff
78fg
78fh
78fi
78fj
78fk
78fl
78fm
78fn
78fo
78fp
78fq
78fr
78fs
78ft
78fu
78fv
78fw
78fx
78fy
78fz
78ga
78gb
78gc
78gd
78ge
78gf
78gg
78gh
78gi
78gj
78gk
78gl
78gm
78gn
78go
78gp
78gq
78gr
78gs
78gt
78gu
78gv
78gw
78gx
78gy
78gz
78ha
78hb
78hc
78hd
78he
78hf
78hg
78hh
78hi
78hj
78hk
78hl
78hm
78hn
78ho
78hp
78hq
78hr
78hs
78ht
78hu
78hv
78hw
78hx
78hy
78hz
78ia
78ib
78ic
78id
78ie
78if
78ig
78ih
78ii
78ij
78ik
78il
78im
78in
78io
78ip
78iq
78ir
78is
78it
78iu
78iv
78iw
78ix
78iy
78iz
78ja
78jb
78jc
78jd
78je
78jf
78jg
78jh
78ji
78jj
78jk
78jl
78jm
78jn
78jo
78jp
78jq
78jr
78js
78jt
78ju
78jv
78jw
78jx
78jy
78jz
78ka
78kb
78kc
78kd
78ke
78kf
78kg
78kh
78ki
78kj
78kk
78kl
78km
78kn
78ko
78kp
78kq
78kr
78ks
78kt
78ku
78kv
78kw
78kx
78ky
78kz
78la
78lb
78lc
78ld
78le
78lf
78lg
78lh
78li
78lj
78lk
78ll
78lm
78ln
78lo
78lp
78lq
78lr
78ls
78lt
78lu
78lv
78lw
78lx
78ly
78lz
78ma
78mb
78mc
78md
78me
78mf
78mg
78mh
78mi
78mj
78mk
78ml
78mm
78mn
78mo
78mp
78mq
78mr
78ms
78mt
78mu
78mv
78mw
78mx
78my
78mz
78na
78nb
78nc
78nd
78ne
78nf
78ng
78nh
78ni
78nj
78nk
78nl
78nm
78nn
78no
78np
78nq
78nr
78ns
78nt
78nu
78nv
78nw
78nx
78ny
78nz
78oa
78ob
78oc
78od
78oe
78of
78og
78oh
78oi
78oj
78ok
78ol
78om
78on
78oo
78op
78oq
78or
78os
78ot
78ou
78ov
78ow
78ox
78oy
78oz
78pa
78pb
78pc
78pd
78pe
78pf
78pg
78ph
78pi
78pj
78pk
78pl
78pm
78pn
78po
78pp
78pq
78pr
78ps
78pt
78pu
78pv
78pw
78px
78py
78pz
78qa
78qb
78qc
78qd
78qe
78qf
78qg
78qh
78qi
78qj
78qk
78ql
78qm
78qn
78qo
78qp
78qq
78qr
78qs
78qt
78qu
78qv
78qw
78qx
78qy
78qz
78ra
78rb
78rc
78rd
78re
78rf
78rg
78rh
78ri
78rj
78rk
78rl
78rm
78rn
78ro
78rp
78rq
78rr
78rs
78rt
78ru
78rv
78rw
78rx
78ry
78rz
78sa
78sb
78sc
78sd
78se
78sf
78sg
78sh
78si
78sj
78sk
78sl
78sm
78sn
78so
78sp
78sq
78sr
78ss
78st
78su
78sv
78sw
78sx
78sy
78sz
78ta
78tb
78tc
78td
78te
78tf
78tg
78th
78ti
78tj
78tk
78tl
78tm
78tn
78to
78tp
78tq
78tr
78ts
78tt
78tu
78tv
78tw
78tx
78ty
78tz
78ua
78ub
78uc
78ud
78ue
78uf
78ug
78uh
78ui
78uj
78uk
78ul
78um
78un
78uo
78up
78uq
78ur
78us
78ut
78uv
78uw
78ux
78uy
78uz
78va
78vb
78vc
78vd
78ve
78vf
78vg
78vh
78vi
78vj
78vk
78vl
78vm
78vn
78vo
78vp
78vq
78vr
78vs
78vt
78vu
78vv
78vw
78vx
78vy
78vz
78wa
78wb
78wc
78wd
78we
78wf
78wg
78wh
78wi
78wj
78wk
78wl
78wm
78wn
78wo
78wp
78wq
78wr
78ws
78wt
78wu
78wv
78ww
78wx
78wy
78wz
78xa
78xb
78xc
78xd
78xe
78xf
78xg
78xh
78xi
78xj
78xk
78xl
78xm
78xn
78xo
78xp
78xq
78xr
78xs
78xt
78xu
78xv
78xw
78xx
78xy
78xz
78ya
78yb
78yc
78yd
78ye
78yf
78yg
78yh
78yi
78yj
78yk
78yl
78ym
78yn
78yo
78yp
78yq
78yr
78ys
78yt
78yu
78yv
78yw
78yx
78yy
78yz
78za
78zb
78zc
78zd
78ze
78zf
78zg
78zh
78zi
78zj
78zk
78zl
78zm
78zn
78zo
78zp
78zq
78zr
78zs
78zt
78zu
78zv
78zw
78zx
78zy
78zz

INK RECEIVING APPARATUS AND METHOD

TECHNICAL FIELD OF THE INVENTION

The present invention relates generally to inkjet apparatus, including inkjet printing mechanisms, and more particularly to an improved print nozzle servicing mechanism.

BACKGROUND OF THE INVENTION

Inkjet printing mechanisms may be used in a variety of different products, such as plotters, facsimile machines and inkjet printers, to print images using a colorant, referred to generally herein as "ink". These inkjet printing mechanisms use inkjet cartridges, often called "pens", to shoot drops of ink onto a page or sheet of print media.

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

By selectively energizing the resistors as the printhead moves across the sheet, the ink is expelled in the desired locations on the print media. The nozzles are typically arranged in one or more linear arrays. If more than one, the two linear arrays are generally located side-by-side on the printhead, parallel to one another, and perpendicular to the scanning direction. Thus, the length of the nozzle arrays defines a print swath or band. That is, if all of the nozzles of one array are continually fired as the printhead makes one complete traverse through the printzone, a band or swath of ink would appear on the sheet. The height of this band is known as the "swath height" of the pen, the maximum pattern of ink that can be laid down in a single pass.

To print an image, (e.g., picture, chart or text) the print media is moved relative to the printhead after a swath has been printed, so that a further swath may be printed adjacent to the earlier swath. By a repetition of this process, a complete printed page may be produced in an incremental manner.

To clean and protect each printhead in order to ensure satisfactory print quality, a "service station" mechanism is typically located within the printer chassis so the printhead can periodically be moved over the station for maintenance.

Generally, such service stations include a number of elastomeric wipers, used to wipe the printhead surface with an ink solvent, such as a polyethylene glycol ("PEG") compound to remove ink residue, as well as any paper dust or other debris that has collected on the-face of the printhead. Service stations usually include a capping system that seals and protects the printhead nozzles from contaminants and drying during non-printing periods, or during storage. Some caps are also designed to facilitate priming, such as by being connected to a pumping unit or other mechanism that draws a vacuum on the printhead. Additionally, service stations usually include one or more reservoirs, termed "spittoons" which are designed to receive and store drops of ink ejected during "spitting" operations. "Spitting" is the term given to the process by which a number of ink drops are fired through one or more nozzles of a printhead in order to unblock a nozzle that may be clogged by dried ink or other matter.

In known spittoon designs two problems are known to arise. The first of these is caused by the generation of airborne aerosol droplets of ink when spitting operations are performed. Such aerosol droplets can cause many problems in printers. For example, airborne droplets may visibly stain areas of the printer with which they come into contact. These areas may include optical devices and sensors used in the printer, thus reducing their effectiveness. Additionally, however, if the aerosol ink of one color ink comes into contact with the pen of a different color ink, or indeed the servicing equipment associated with a pen of a different color ink, cross contamination of the ink may arise. This may lead to a visible deterioration in the quality of the printed output of the printer, which may even require the replacement of an effected pen and its associated servicing equipment.

The amount of aerosol ink that is generated during a spitting operation is dependent upon a variety of factors. These may include: the architecture of the pens; the firing frequency; the ink drop volume; the composition of the ink; and, the temperature. However, it is also dependent upon the design of the spittoon used together with the "spitting distance"; i.e. the distance that the ink drops travel between leaving the printhead and contacting a surface of the spittoon or liquid ink held in the spittoon. In general, there exists a desirable spitting distance, beyond which the greater the spitting distance the greater the amount of aerosol that will be generated.

The second problem associated with spittoon designs concerns space. With many printers for example, especially those intended to be located upon a desk top, it is generally desirable that their size (especially their "footprint") should be as small as possible. Since printer service stations are generally laterally offset from the printzone, their size often contributes directly to the footprint of the printer. Thus, there is an incentive to reduce the size of the service stations and spittoons as far as possible.

Because of the space restrictions imposed upon the design of printer service stations, a trade off usually exists between the size of the printer and both the design of the spittoon and the spitting distance; both of which effect the amount of aerosol droplets generated when spitting operations are performed.

It would therefore be desirable to provide a system for servicing ink jet pens, which overcomes one or more of the above problems.

SUMMARY OF THE INVENTION

An overall goal of the present invention is to provide a system and method for allowing improved servicing of inkjet printheads.

Another goal of the present invention is to provide an apparatus and method, which allows the aerosol effect of spitting operations in inkjet apparatus to be reduced to satisfactory levels.

It is a further goal of the present invention is to provide a spittoon system for inkjet apparatus, which does not unduly increase the space required by the printhead servicing apparatus in ink jet apparatus.

According to one aspect of the present invention there is provided an ink jet device comprising at least one printhead arranged to eject ink drops in a spitting operation and a spittoon arranged to store said ejected ink, the device further comprising a temporary spittoon arranged to move between first and second positions, said temporary spittoon being arranged in said first position such that said ink drops are ejected onto a surface of said temporary spittoon, said temporary spittoon being further arranged to transfer said ink to said spittoon when in said second position.

By providing a mobile spitting frame, or temporary spittoon, which acts as both a means of receiving ink ejected from a printhead during a spitting operation from a position close to the nozzle plate of the printhead, and as a means of transporting that ink to a permanent ink store more distant from the nozzle plate of the printhead, various advantages are realised.

It allows the "spitting distance" to be reduced to a level where the effect of aerosol is reduced to an acceptable level; thus, the risk of cross contamination of ink supplies may be greatly reduced.

By using a mobile spitting frame, the spitting distance may be reduced whilst leaving sufficient space adjacent to the nozzle plate of the printheads for other servicing activities, such as wiping and capping, to be implemented when spitting operations are not being performed.

Additionally, since the ink may be transferred from the spitting frame to a spittoon between spitting operations, the "spitting distance" will not decrease with the number op spitting operations. Therefore, the aerosol effect may be optimised throughout the life of the spittoon, irrespective of how much ink the spittoon contains.

Furthermore, since the present invention allows optimal "spitting distances" to be achieved whilst preserving sufficient space for other servicing activities, such as wiping and capping, the present invention may be used in a great range of ink jet devices in a manner which is largely independent of the geometry limitations and spittoon requirements of those devices. Because of this, the present invention offers the possibility of significant savings to manufacturers of ink jet devices.

Furthermore, by transferring ink indirectly from the spitting frame to the spittoon, a compact and efficient spittoon design may be used.

The present invention also extends to the method corresponding to the apparatus.

For a better understanding of the invention and to show how the same may be carried into effect, there will now be described by way of example only, specific embodiments, methods and processes according to the present invention with reference to the accompanying drawings in which:

BRIEF DESCRIPTION OF THE DRAWINGS

FIGS. 3*a–c* illustrate the working of the spitting frame of FIG. 2 during a maintenance operation.

DETAILED DESCRIPTION OF THE PREFERRED EMBODIMENTS

There will now be described by way of example only the best mode contemplated by the inventors for carrying out the invention.

First Embodiment

Figure 1:
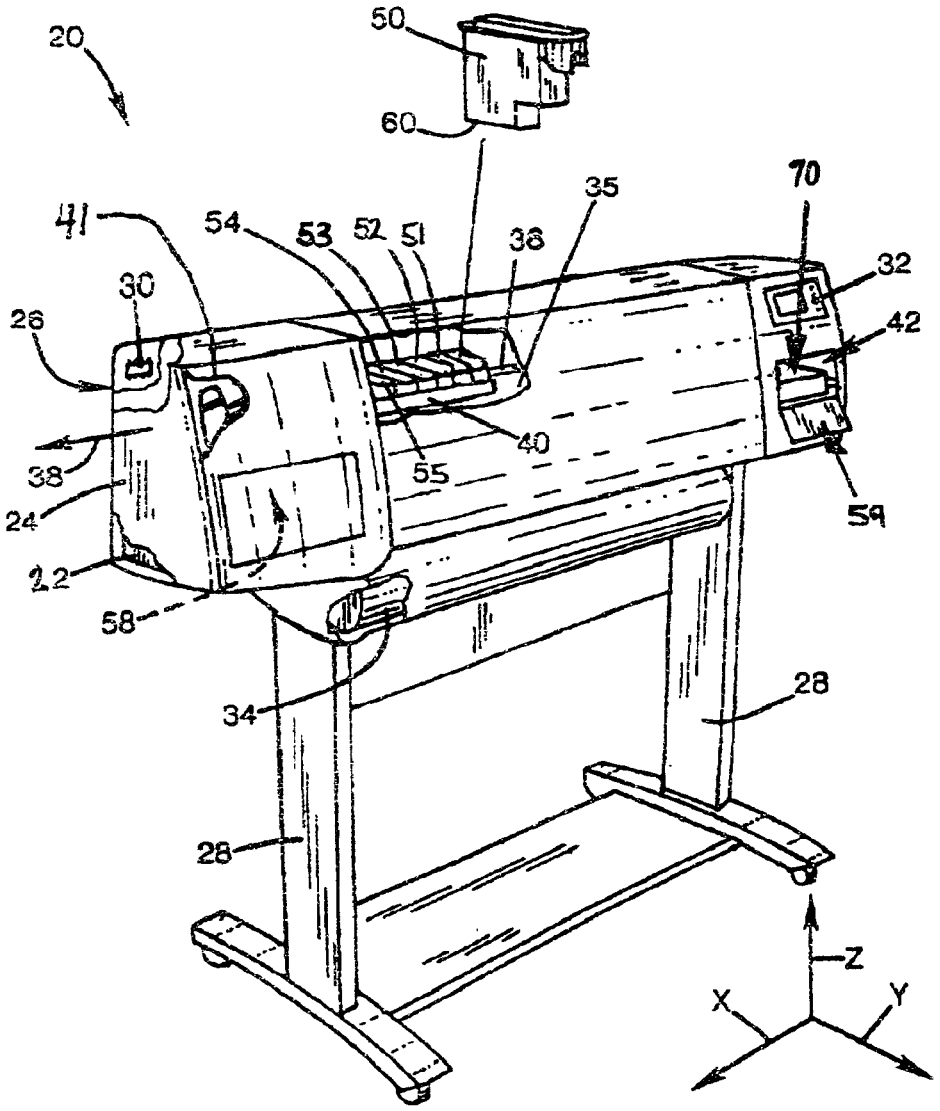
FIG. 1 is a perspective view of one form of an inkjet printing mechanism, here an inkjet printer, suitable for use with the present invention.

FIG. 1 illustrates an embodiment of an inkjet printing mechanism, here shown as an inkjet printer 20, which is suitable for use with the present invention. The printer 20 may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28.

The printer 20 also has a printer controller, illustrated schematically as a microprocessor 30 that receives instructions from a host device, which is typically a computer, such as a personal computer or a computer aided drafting (CAD) computer system (not shown). The printer controller 30 may also operate in response to user inputs provided through a key-pad and status display portion 32, located on the exterior of the casing 24. A monitor coupled to the computer host may also be used to display visual information to an operator, such as the printer status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media 34 may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35.

A conventional carriage drive motor 41 may be used to propel the carriage 40 in response to a control signal received from the controller 30. To provide carriage positional feedback information to the controller 30, a conventional metallic encoder strip (not shown) may be extended along the length of the printzone 35 and over the servicing region 42. A conventional optical encoder reader (not shown) may be mounted on the back surface of printhead carriage 40 to read positional information provided by the encoder strip; for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Moreover, the illustrated inkjet printing mechanism may also be used for printing images on pre-cut sheets, rather than on media supplied in a roll 34.

In the printzone 35, the media sheet receives ink from an inkjet cartridge, such as a black ink cartridge 50, an enlarged view of which is shown in FIG. 1, and five monochrome color ink cartridges 52, 54 and 56. Each of the cartridges, often called "pens" by those in the art, is mounted on the inkjet carriage 40. In the present embodiment, each of the pens 50, 51, 52, 53, 54 and 55 contains dye-based ink.

The illustrated printer 20 uses an "off-axis" ink delivery system, having main stationary reservoirs (not shown) for each ink (black, cyan, magenta, yellow, light cyan and light magenta) located in an ink supply region 58. In this off-axis system, the pens 50-55 may be replenished by ink conveyed through a conventional flexible tubing system (not shown) from the stationary main reservoirs, so only a small ink supply is propelled by carriage 40 across the printzone 35, which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 51, 52, 53, 54 and 55 each have a printhead (of which only printhead 60 of the pen 50 is illustrated in the figure), which selectively ejects ink to form an image on a sheet of media 34 in the printzone 35. These inkjet printheads have a large print swath, for instance about 20 to 25 millimeters (about one inch) wide or wider, although the printhead maintenance concepts described herein may also be applied to smaller inkjet printheads.

The inventive concepts disclosed herein apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

Each printhead has an orifice plate with a plurality of nozzles formed therethrough in a manner well known to those skilled in the art. The nozzles of each printhead are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. In the present embodiment, the printheads are thermal inkjet printheads, although other types of printheads may be used, such as piezoelectric printheads. The thermal printheads typically include a plurality of resistors associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

The user may gain access to the servicing region 42 via an access panel 59. As can be seen in the figure, the access panel 59 is in its open state and the service station 70 of the printer 20 may be seen.

Figure 2:
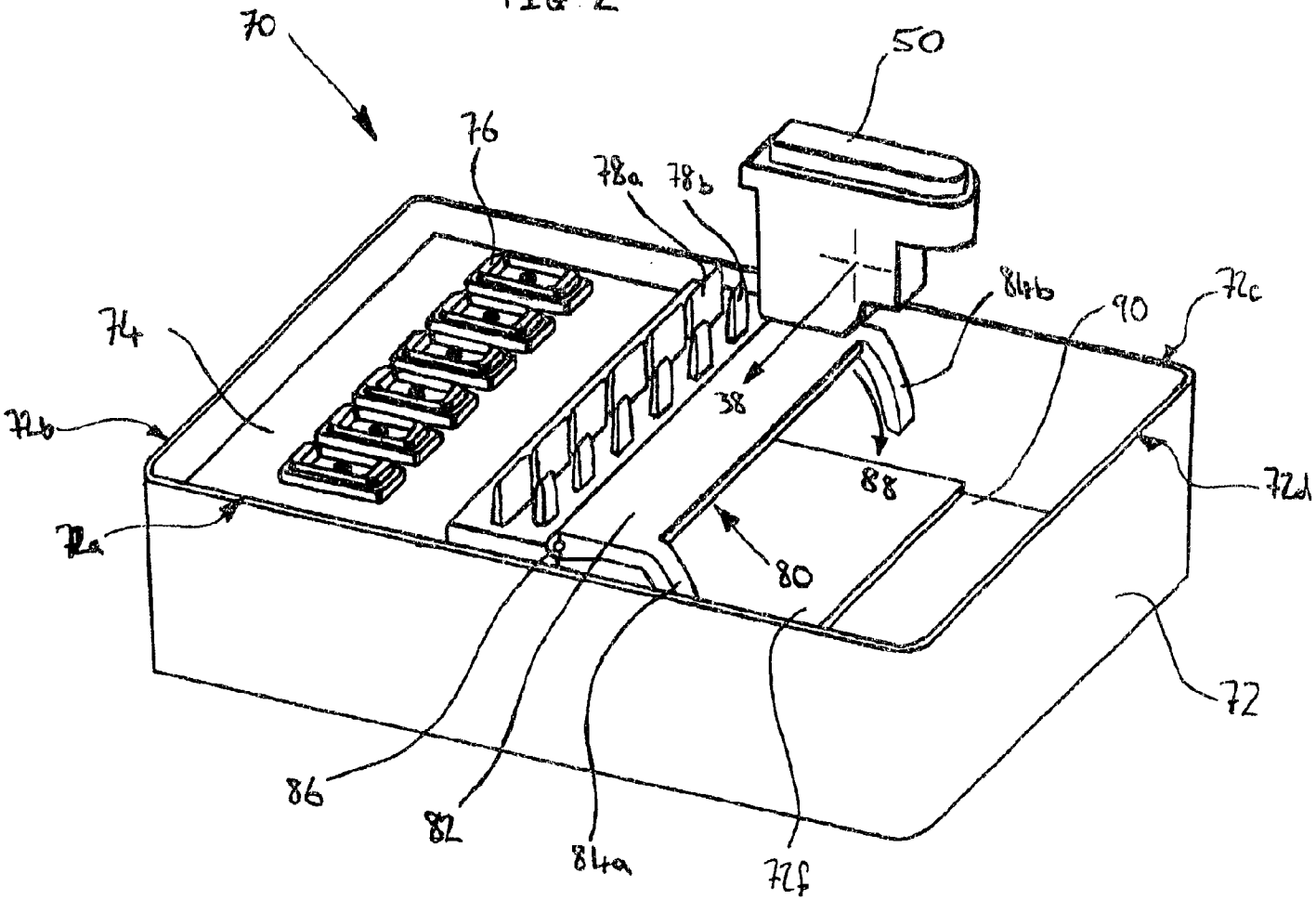
FIG. 2 is a perspective partial view of a printer service station, including a spitting frame according to a first embodiment of the invention.

Referring now to FIG. 2 a perspective partial view of the service station 70 of the printer 20 is shown. The figure shows elements of the service station 70 in their normal, non-active positions; i.e. the positions prior to implementing a servicing operation. As can be seen from the figure, the spittoon 72 is orientated such that its front and rear walls, 72*d* and 72*b* respectively, are parallel with the scanning axis 38.

Also shown in the figure is a single pen, the black pen 50, which is in its servicing position. For the sake of clarity, none of the remaining five pens 51–55 or the carriage 40 is shown in the figure. However, when the carriage 40 is in its servicing position, each of the remaining five pens are aligned with the black pen 50 shown, along the scanning axis 38 and above the spittoon 72.

Figure 3A:
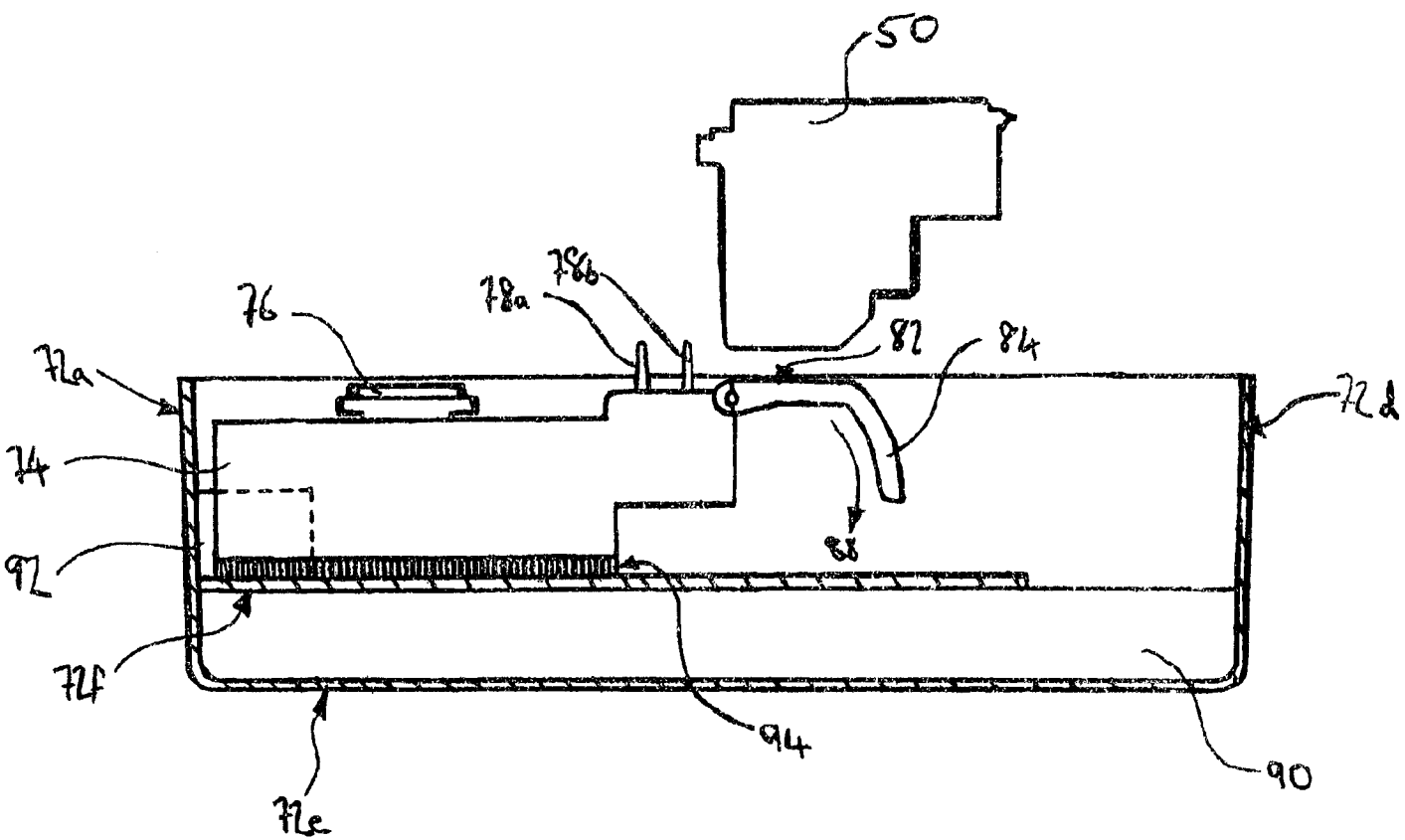
Figure 3B:
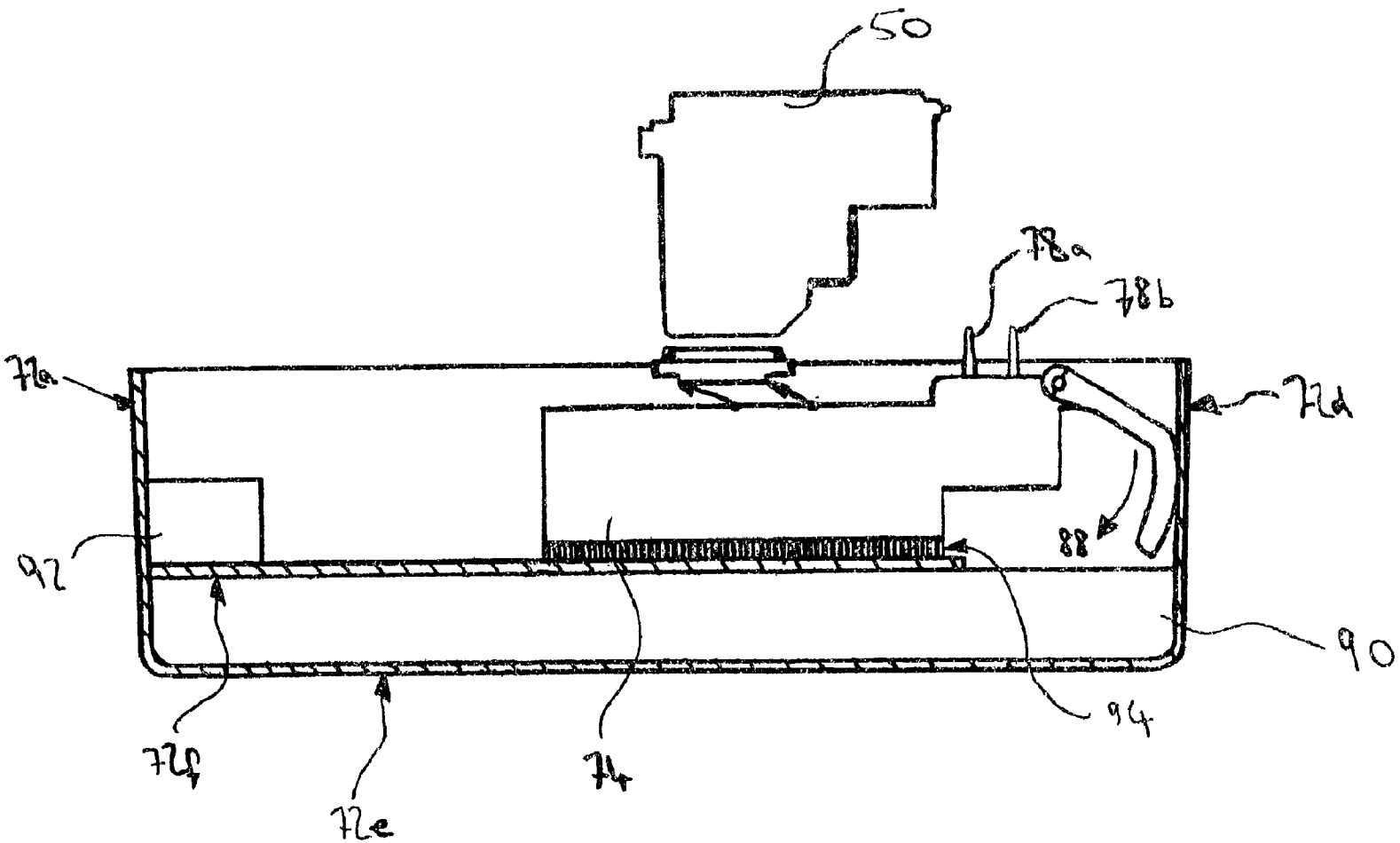

In the present embodiment, the spittoon 72 comprises a box shaped structure with four side walls 72*a–d* and a lower wall 72*e* (shown in FIGS. 3*a–c*). As can be seen from the figure, the top side of the spittoon 72 is open.

A shuttle 74 is located in the spittoon 72. The shuttle supports various elements involved in servicing the pen, which are described more fully below. The shuttle 74 is located on an internal surface 72*f* of the spittoon 72. The shuttle 74 is arranged to move in a reciprocal manner between the front wall 72*d* and the rear wall 72*b* of the spittoon 72, to actuate pen servicing processes, including the wiping and capping, in a manner know in the art.

Six pen caps manufactured from an elastomeric material are mounted on the upper surface of the shuttle 74. In the figure only the cap 76, which is arranged to cap the black pen 50, is referenced. The caps are arranged such that in operation, each pen may be capped simultaneously by its corresponding cap, which is sized to extend around the nozzles of the pen when in a capping position. Thus, during periods of non-use the nozzles in each pen may be sealed by a cap from the surrounding atmosphere preventing the nozzles of the pens from drying out. The caps may be conventional in the art, examples of which are disclosed in U.S. Pat. No. 6,203,135 entitled "Independent Servicing Of Multiple Inkjet Printheads", in the name of Hewlett-Packard Co, which is hereby incorporated by reference in its entirety.

Each cap is mounted to the shuttle 74 by a mounting structure (not shown). The mounting structures allows each cap to be moved from a "non-capping position" as shown in FIG. 3*a* when the printheads are not capped to a "capping position" as shown in FIG. 3*c* when the printheads are capped. Any suitable mounting structure known in the art may be used in conjunction with present embodiment. For example, the caps may be mounted by pivoting arms to the shuttle. As the shuttle moves relative to the printheads, cams and cam followers located on the shuttle and the print carriage may cause the caps to move vertically from the "non-capping position" to the "capping position" when the shuttle is brought into the correct position relative to the printheads. When the shuttle is again moved away from the printheads, the caps may be returned to the "non-capping position" under the influence of a return spring.

Also mounted on the upper surface of the shuttle 74 are a series of flexible, resilient, non-abrasive, elastomeric wipers manufactured from a material such as nitrile rubber, or more preferably, ethylene polypropylene diene monomer (EPDM). In the present embodiment, two wipers are arranged to wipe each printhead. In the figure only wipers 78*a* and 78*b*, which are arranged to wipe the black pen 50, are referenced. However, a similar pair of wipers is arranged to simultaneously wipe each pen during a wiping operation. During a wiping operation, the wipers are arranged to apply a solvent such as PEG from a reservoir (not shown) to the nozzle plate of each printhead in order to clear the nozzle plate and dissolve any dried ink that might be present. However, any suitable wiping mechanism may be used in conjunction with the present invention. An example of a suitable wiping mechanism is disclosed in the Hewlett-Packard Company's U.S. Pat. No. 5,614,930, which is hereby incorporated by reference in its entirety.

A spitting frame 80 according to the present invention is also mounted on the shuttle 74. In the present embodiment, the spitting frame comprises a substantially planar surface 82, and two cam surfaces 84*a* and 84*b*, which extend from the surface 82 towards the front wall 72*d* of the spittoon. The spitting frame 80 is rotatably mounted on the shuttle 74 by a hinge 86. In this manner it may rotate in the direction of the arrow 88 against the force of a return spring (not shown), which may be a standard coil spring. Thus, due to the effect of the return spring, the resting position of the spitting frame 80 is that shown in FIG. 2 (i.e. with the surface 82 substantially parallel to the lower wall 72*e* of the spittoon 72).

In the present embodiment, the each of the spittoon 72, the shuttle 74 and the spitting frame are manufactured from plastics materials using a suitable manufacturing method, such as injection moulding. However, the skilled reader will appreciate that different materials and manufacturing methods may instead be used.

In the present embodiment, the lower portion of the spittoon 72 (i.e. the volume of the spittoon lying below the internal surface 72*f*) is filled with an ink absorber 90, as is more clearly shown in FIGS. 3*a–c*. This is preferably a foam material, although a variety of other absorbing materials may also be used. The absorber 90 receives ink, which has been ejected by the printheads in spitting operations and holds the liquid that remains when all possible evaporation has occurred.

Thus, as is clear from the above description, the spittoon 72 of the present embodiment is designed not only to receive ink that has been ejected in spitting operations but also to act as a structural element supporting other elements of the service station 70, including the shuttle 74. However, the skilled reader will appreciate that in practice this need not be the case. That is to say that a separate support element or elements may instead be used to support other elements of the service station 70.

Referring now to FIGS. 3*a–c*, the mode of operation of the spitting frame 80 will be described.

FIG. 3*a* illustrates a partial cross sectional view of the apparatus shown in FIG. 2, in a direction perpendicular to the scanning axis 38. In the figure, the shuttle 74 is shown positioned ready for a spitting operation to be implemented. In this position, the surface 82 of the spitting frame 80 is located such that it simultaneously extends under the nozzles of each of the printheads of the printer carriage 40. Furthermore, the surface 82 of the spitting frame 80 is maintained horizontal under the action of the return spring (not shown). The skilled reader will appreciate that due to the dimensions of the spitting frame of the present embodiment, all of the pens may spit simultaneously. Thus, time may be saved when implementing spitting operations.

Thus, ink drops ejected from any nozzle of any of the six printheads will be directed towards, and will impact against the horizontal, planar surface 82 of the spitting frame 80. In the present embodiment, the preferred distance between the nozzle plate of each printhead and the surface 82 when it is positioned horizontally as shown in FIG. 3*a* (i.e. "spitting distance") is approximately 6 mm. It has been determined, in the present embodiment, that this distance reduces the aerosol effect experienced when spitting to a satisfactory level. The skilled reader will appreciate that the preferred "spitting distance" will depend upon a number of factors determined by the operational set up of individual ink jet apparatus. These may include: the velocity of drop ejection of the printheads when spitting; the properties of the ink being used; and the surface finish and material properties of the surface 82. Thus, the optimal "spitting distance" may be determined by routine experimentation.

However, it has been determined that if the "spitting distance" is reduced much beyond 6 mm, the aerosol effect is increased when spitting frame is manufactured from a hard plastic material, such as is the case in the present embodiment due to the ink drops splashing against the spitting frame surface. However, if the surface of the spitting frame is made from a softer material such, as foam, the spitting distance may be reduced to approximately 1 mm, whilst efficiently reducing the aerosol effect. It has also been determined that the "spitting distance" may be increased to 10 mm or more whilst continuing to reduce the aerosol effect in a beneficial, although reduced manner.

The dimensions of the planar surface 82 of the spitting frame 80 are preferably determined such that under normal conditions, ink ejected in a spitting operation forms a shallow pool on the surface 82; i.e. without flowing off the surface 82 whilst the spitting frame 80 is horizontal. The required dimensions will depend on, amongst other factors, the viscosity and quantity of the ejected ink and the surface finish and material properties of the surface 82. The dimensions of the spitting frame may be determined by routine experimentation.

In the present embodiment, once a spitting operation has been completed, the shuttle 74 is translated towards the front wall 72*d* of the spittoon 72. This is achieved in the present embodiment using a standard electric motor 92. In response to a drive signal received from the controller 30, the motor is arranged to drive a gear (not shown), which in turn drives a rack 94 attached to the shuttle 74. However, the skilled reader will appreciate that any other suitable drive mechanism may instead be used.

As the shuttle is translated forwards towards the front wall 72*d* of the spittoon 72, the wipers wipe, and so clean, the nozzle plates of the printheads. As the shuttle approaches its maximum travel in the forward direction, the two cam surfaces 84*a* and 84*b*, extending from the surface 82 of the spitting frame 80, contact the front wall 72*d* of the spittoon. Due to the curvature of the cam surfaces 84*a* and 84*b* further movement of the shuttle 74 in the forwards direction causes the spitting frame 80 to rotate in the direction of arrow 88 about the hinge 86. In this manner the spitting frame rotates in the direction of the arrow 88 against the force of a return spring (not shown), as is shown in FIG. 3*b*.

Finally, as the shuttle reaches its position of maximum travel towards the front wall 72*d* of the spittoon 72, the spitting frame 80 has preferably rotated approximately 90 degrees as is shown in FIG. 3*c*. In this position, the surface 82 of the spitting frame 80 is approximately vertical.

As the orientation of the spitting frame is altered from horizontal to vertical, the ink on the spitting frame is allowed to flow under the influence of gravity to the bottom of the spittoon 72. As can be seen from FIGS. 3*a–c*, the internal surface 72*f* of the spittoon 72 does not extend all the way to the forward end of the spittoon 72 (i.e. adjacent to the front wall 72*d* of the spittoon 72). Thus, as the ink runs off the spitting frame 80 as it tilts, the ink runs off onto the ink absorber 90, where it is absorbed.

The skilled reader will thus appreciate that the change in orientation of the spitting frame, as ink is transferred to the spittoon results in a compact design, which conserves space.

Preferably, when the shuttle 74 has approximately reached its position of maximum travel towards the front wall 72*d* of the spittoon 72, the surface 82 of the spitting frame 80 is urged against the front wall 72*d* of the spittoon 72, under the action of the motor 94. This has the effect of displacing any ink still present from the surface 82 of the spitting frame 80 and causing it to run down the front wall 72*d* of the spittoon 72. In this manner, it is ensured that ink transferred from the spitting frame surface 82 to the ink absorber 90 is more efficient.

It is also desirable that the front wall 72*d* of the spittoon 72*a* has an inner surface, which is made of an absorbent and compressible material (not shown), such as a foam material, in the region against which the spitting frame surface 82 is urged. In this manner, the efficiency of the ink transfer from the spitting frame 80 to the spittoon 72 may be further increased.

As the orientation of the spitting frame is altered from horizontal to vertical, the caps progressively move from "non-capping positions" as shown in FIG. 3*a*, via an intermediate position shown in FIG. 3*b* to "capping positions" as shown in FIG. 3*c*, under the action of their mounting structures (not shown) as discussed above.

Finally, the motor 92, is arranged to drive the shuttle 74 in the reverse direction (i.e. towards the rear wall 72*a* of the spittoon 72), in response to a drive signal received from the controller 30. Thus, the spitting frame may once again be located ready for a further spitting operation, as is shown in FIG. 3*a*.

The skilled reader will appreciate that the method for transferring ink from the spitting frame to the spittoon described in the present embodiment may be realised in other ways. For example, the spitting frame may move from a substantially horizontal position to a substantially vertical position, as it approaches the end wall 72*d* of the spittoon, without being hingedly mounted to the shuttle. Instead if the spitting frame is manufactured from a flexible material, such as a rubber or a plastic material, which allows it to deform from a horizontal position to a vertical position under the camming effect of surfaces such as cams 84*a* and *b*, it may be rigidly mounted to the shuttle 74; for example by adhesive bonding.

Second Embodiment

The second embodiment generally employs the same apparatus and generally operates in the same manner as described with reference to the first embodiment. Therefore, similar apparatus and methods of operation will not be described further. Additionally, similar components are illustrated and numbered in the same manner as is the case in the earlier embodiment.

As has been stated above, each of the inks used by the printheads in the embodiment described above are dye based. The constraints on spittoons for pigment-based inks, however, differ from those for dye-based inks due to the differences in the composition of the two types of ink. Whereas dye-based inks leave a liquid residue that may be stored in an ink absorbing foam, when all possible evaporation has occurred, this is not the case for pigment-based inks. Pigment-based inks have a higher solid content than dye-based inks, and leave a solid, tar-like residue when all possible evaporation has occurred. Therefore, ink-absorbing foam is not a suitable method of storing the residue of pigment-based inks ejected during spitting operations.

Traditionally, spittoons for pigment-based inks are empty chambers, which fill with the pigment-based ink residue throughout the working life of the spittoon. Due to the lack of ink absorbing foam in spittoons for pigment-based inks, the "spitting distance" for pigment-based inks is generally greater than is the case for dye-based inks. Thus, the quantity of aerosol produced in during spitting operations is generally higher for pigment-based inks than for dye-based inks. Therefore, the spitting frame of the present invention is particularly beneficial for use with pigment-based ink.

Figure 4:
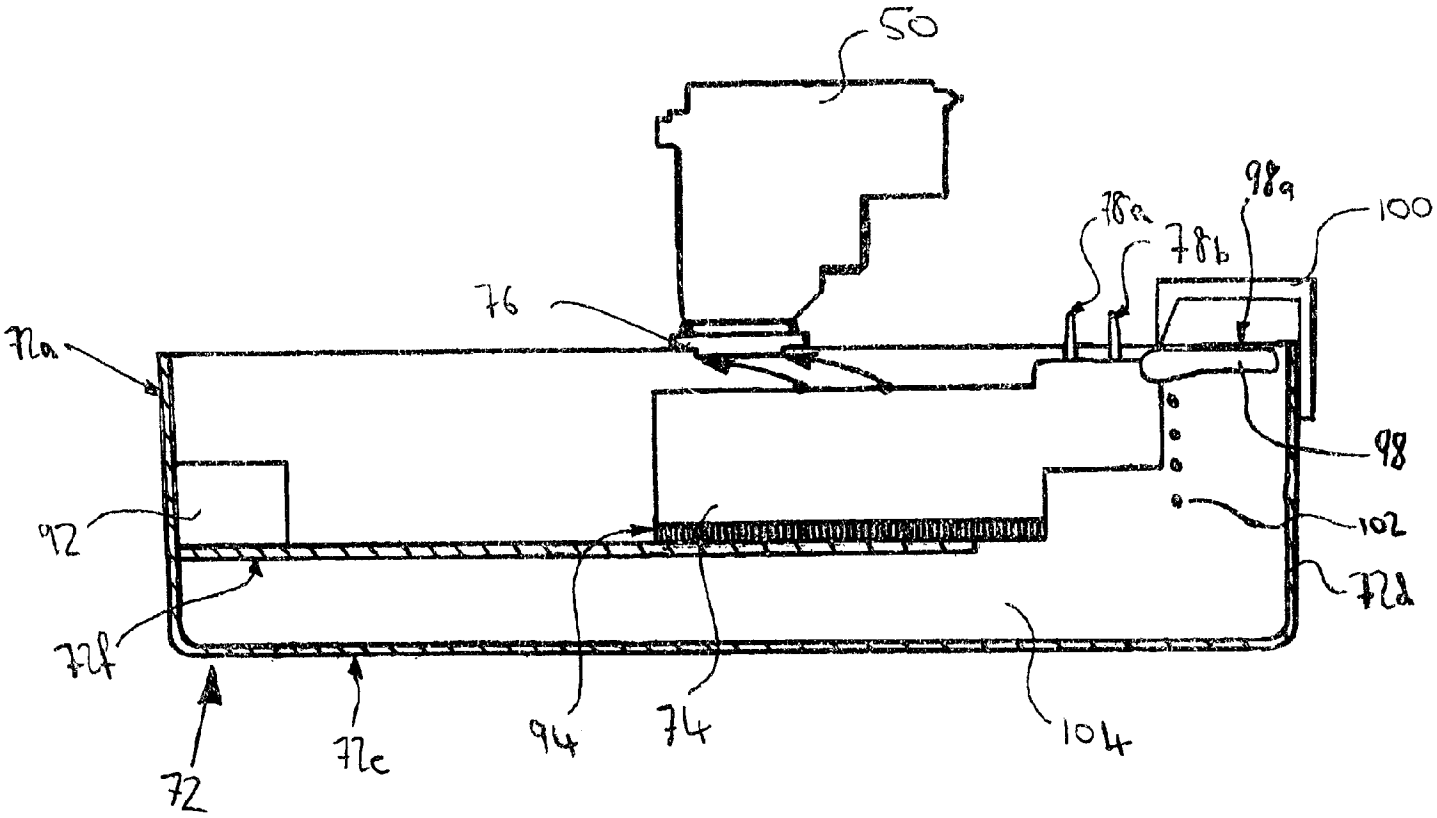
FIG. 4 illustrates the working of the spitting frame of a second embodiment of the invention during a maintenance operation.

However, due to the high solid content of pigment-based inks, it is preferable that where the present invention is used in conjunction with pigment-based inks, the pigment-based ink that is collected on the spitting frame surface 82 is actively removed using a scraper. Referring to FIG. 4, a scraper arrangement for use with pigment-based ink is schematically illustrated.

FIG. 4 illustrates a partial cross sectional view of the service station apparatus of the second embodiment of the invention, which corresponds to the view of the service station apparatus of the first embodiment shown in FIG. 3*c*. The service station apparatus of the second embodiment is, like the service station apparatus of the first embodiment, suitable for use with the printer 20 described in the first embodiment.

In this embodiment, the spitting frame 98 is fixedly mounted on the shuttle in a horizontal orientation. Because of this, the spittoon 72 is extended in the direction of travel of the shuttle to accommodate the extra length of the shuttle 74 and the spitting frame 98 combined, when in the "capping position", as shown in FIG. 4.

As can be seen from the figure, a scraper device 100 is mounted on the front wall 72*d* of the spittoon 72. The scraper is arranged to scrape the spitting frame surface 82 as it moves beneath the scraper 100 under the action of the motor 94, both in a forwards and a backwards direction. in this manner, the pigment-based ink that accumulates on the spitting frame surface 98*a* during spitting operations may be effectively removed. As can be seen from the figure, the pigment-based ink 102 falls through a space (not shown) between the spitting frame 98 and the shuttle 74, when the shuttle 74 moves in a forward direction. When the shuttle 74 moves in a backward direction any remaining ink on the spitting frame surface 98*a* falls off the leading edge of the spitting frame 98.

In this manner, the build up of dried pigment-based ink on the spitting frame is avoided, which may otherwise impact against the nozzle plate of a printhead. The ink scraped off spitting frame surface 98*a* is then allowed to fall to the base 104 of the spittoon, where it may be stored for the working life of the spittoon, or until it is removed by an operator.

As can be seen from FIG. 4, the spittoon 72 contains no ink absorber 90, due to its unsuitability for use with pigment-based ink, as is discussed above. Furthermore, in the present embodiment, the internal surface 72*f* of the spittoon 72 is arranged to extend less far towards the front wall 72*d* of the spittoon than was the case in the first embodiment. This modification helps allow the dried pigment-based ink that was scraped off the spitting frame to distribute freely in the base 104 of the spittoon.

The skilled reader will appreciate that in the present embodiment, one or more, or indeed all of the printheads used in the printer 20 may print with pigment-based ink. The skilled reader will also appreciate that only those portions of the spitting frame 98 upon which pigment-based ink is ejected require a scraper device, according to the present embodiment. Thus, one or more individual scraper devices may be used to clean the ink ejected by a plurality of printheads.

The skilled reader will further appreciate that various modifications may be made to this embodiment. For example, the spitting frame could alternatively be rotatably mounted on the shuttle, as was described in the first embodiment. This has the advantage that the spittoon length between the front wall 72*d* and the back wall 72*a* of the spittoon may be reduced. In this case, the scraper 100 may be mounted on the internal surface of the front wall 72*d* of the spittoon.

Furthermore, the force exerted by the scraping device(s) on the spitting frame may be adjusted to optimise its cleaning effect. This may be achieved using a spring system and/or other techniques known in the art.

Further Embodiments

In the embodiments described above, numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, where the invention is used with a combination of dye-based and pigment-based ink, the skilled reader will appreciate that it may be desirable, for economic, or other reasons to adapt the apparatus of the first embodiment described above in the following manner. The spitting frame may be designed to incorporate one or more holes that are arranged to allow the pigment-based ink ejected during spitting operations to pass directly through the spitting frame and into the spittoon. The ink from the remaining dye-based pens may be collected on the spitting frame and transferred to the spittoon in the normal manner. In this case, although the aerosol effect for the pigment-based ink will not be significantly reduced, the anti-aerosol effect of the present invention may be realised for the dye-based ink. However, if for example, the proportion of the pens using pigment-based ink is low, for example one out of four or six pens, then this modification will ensure a significant reduction in aerosol effect, without incurring the extra expense of a scraper mechanism.

Furthermore, in the case of dye based ink, the spitting frame could consist simple of a foam surface supported in a frame, which is movable between an optimally selected spitting position adjacent the printheads a position more distant from the printheads adjacent or indeed resting on the an ink absorber located in the spittoon. Thus, for example, the spitting frame could be located adjacent or immediately below the printheads during a spitting operation. After the spitting operation, the spitting frame could be driven away from the printheads by an electric motor, preferably, translated vertically downwards until it is in contact with the ink absorber. In this manner, the space adjacent the printheads is vacated by the spitting frame in order that wiping and capping operations may be performed. Simultaneously, the ink ejected during the spitting operation is able to flow gradually, under gravity and capillary action, through the foam material of the spitting frame into the ink absorber for permanent storage. Thus, the spitting frame does not become saturated with ink and is ready to receive more ink in a further spitting operation at a later point in time, when it is simply raised up, into place by the electric motor. This embodiment benefits from the advantage of not requiring the spitting frame to be rotated in order to facilitate the transfer of the ink from the spitting frame to the spittoon. The skilled reader will again appreciate that this embodiment may be used in conjunction with those pens of an inkjet device, which use dye-based inks, in an inkjet device that uses both pigment and dye-based inks. That is to say, the pigment-based ink ejected during spitting operations may be arranged to pass directly into a spittoon, as discussed above.

Additionally, although in the above described embodiments the action of transferring ink collected on the spitting frame to the base of the spittoon also caused the printheads to be wiped and capped, the skilled reader will appreciate that this need not be the case in practice. For example, both the wiping and capping actions could be actuated using cams, reliant upon the motion of the shuttle, which may be disengaged when required. This may be done either manually or automatically. In this manner, the ink may be transferred from the spitting frame to the spittoon without causing either a wiping operation or a capping operation, or both, as may be required.

What is claimed is:

1. An inkjet device comprising:

at least one printhead arranged to eject ink drops in a spitting operation;

a spittoon arranged to store the ejected ink; and a generally planar shelf mounted for rocking motion between:

a first position for directly receiving and retaining the ejected ink from the printhead, and a second position for transferring the received ink to the spittoon by spilling the received ink from the shelf into the spittoon.

2. A device according to claim 1, wherein:

the shelf is substantially horizontal when in the first position.

3. The device of claim 1, wherein:

the shelf is substantially rigid.

4. An inkjet device comprising:

at least one printhead arranged to eject ink drops in a spitting operation;

a spittoon arranged to store the ejected ink; and a substantially noncylindrical temporary spittoon arranged to reciprocate between first and second positions, said substantially noncylindrical temporary spittoon being arranged in the first position so that the ink drops are ejected onto a surface of said substantially noncylindrical temporary spittoon, and said substantially noncylindrical temporary spittoon being further arranged to transfer the ink to the spittoon when in the second position;

wherein the surface of the temporary spittoon is approximately 1 mm to 10 mm from the printhead when the temporary spittoon is in the first position.

5. A device according to claim 4, wherein:

said temporary spittoon is located such that the spitting distance is approximately 6 mm from said printhead when said temporary spittoon is in said first position; and reciprocation of the shuttle is substantially rectilinear.

6. An inkjet device comprising:

at least one printhead arranged to eject ink drops in a spitting operation;

a spittoon arranged to store the ejected ink; and a substantially noncylindrical temporary spittoon arranged to move between first and second positions, said temporary spittoon being arranged in the first position so that the ink drops are ejected onto a surface of said temporary spittoon, and said temporary spittoon being further arranged to transfer the ink to the spittoon when in the second position;

wherein the temporary spittoon is mounted on a shuttle, said shuttle being arranged to move the temporary spittoon between the first and second positions.

7. A device according to claim 6, wherein:

the temporary spittoon is arranged to be oriented in a first orientation when in the first position and in a second orientation different from the first orientation when positioned in the second position, such that when positioned in the second position the temporary spittoon is arranged to transfer the ink from the spittoon surface by gravity; and motion of the shuttle is reciprocating.

8. A device according to claim 6, wherein:

said temporary spittoon further comprises one or more holes, arranged such that ink ejected by one or more of said at least one printhead may pass directly to a non-temporary spittoon.

9. A device according to claim 6, wherein:

the device is arranged so that in the second position the temporary spittoon is located substantially in contact with the spittoon or ink stored therein, the temporary spittoon being adapted so that the ink on the temporary spittoon surface is able to flow from the temporary spittoon to the spittoon.

10. A device according to claim 6, wherein:

the temporary spittoon comprises a porous body adapted to allow the ink on the temporary spittoon surface to flow through the temporary spittoon to the spittoon.

11. The device of claim 6, wherein:

the shuttle is arranged for substantially linear translation, exclusively.

12. An inkjet device comprising:

at least one printhead arranged to eject ink drops in a spitting operation;

a spittoon arranged to store the ejected ink; and a temporary spittoon arranged to move between first and second positions, said temporary spittoon being arranged in the first position so that the ink drops are ejected onto a surface of said temporary spittoon, and said temporary spittoon being further arranged to transfer the ink to the spittoon when in the second position;

wherein the temporary spittoon is mounted on a shuttle, said shuttle being arranged to move the temporary spittoon between the first and second positions;

the temporary spittoon is arranged to be oriented in a first orientation when in the first position and in a second orientation different from the first orientation when positioned in the second position, such that when positioned in the second position the temporary spittoon is arranged to transfer the ink from the spittoon surface by gravity; and the temporary spittoon is rotatably mounted to the shuttle and arranged to pivot relative to the shuttle between the first and second orientations.

13. A device according to claim 12, wherein:

the temporary spittoon is arranged to rotate relative to the shuttle under the action of one or more cam surfaces.

14. An inkjet device comprising:

at least one printhead arranged to eject ink drops in a spitting operation;

a spittoon arranged to store said ejected ink;

a substantially noncylindrical temporary spittoon arranged to move along a substantially linear path between first and second positions, said temporary spittoon being arranged in the first position so that the ink drops are ejected onto a surface of the temporary spittoon, and said temporary spittoon being further arranged to transfer the ink to the spittoon when in the second position; and wherein:

the surface of the temporary spittoon is substantially horizontal when the temporary spittoon is in the first position;

the temporary spittoon is mounted on a shuttle, the shuttle being arranged to move the temporary spittoon between the first and second positions; and the temporary spittoon is arranged to be oriented in a first orientation when in the first position and in a second orientation different from the first orientation when positioned in the second position, such that when positioned in the second position the temporary spittoon is arranged to transfer the ink on the spittoon surface under gravity; and the temporary spittoon comprises a flexible material fixedly mounted to the shuttle, the temporary spittoon being arranged to bend or deform between the first and second orientations.

15. A device according to claim 14, wherein:

said temporary spittoon is arranged to bend or deform under the action of one or more cam surfaces; and motion of the shuttle along the substantially linear path is reciprocating.

16. A device according to claim 15, wherein:

said shuttle is further arranged to urge said temporary spittoon against a further surface when said temporary spittoon is approximately located in said second position, forcing said ink from said temporary spittoon surface.

17. A device according to claim 16, wherein:

said surface of said temporary spittoon is manufactured from a plastics material.

18. A device according to claim 16, wherein:

said surface of said temporary spittoon is manufactured from a foam material.

19. An inkjet device comprising:

at least one printhead arranged to eject ink drops in a spitting operation;

a spittoon arranged to store the ejected ink;

a temporary spittoon arranged to move between first and second positions, said temporary spittoon being arranged in the first position so that the ink drops are ejected onto a surface of the temporary spittoon, and said temporary spittoon being further arranged to transfer the ink to the spittoon when in the second position;

wherein the surface of the temporary spittoon is substantially horizontal when the temporary spittoon is in the first position; and wherein the temporary spittoon is mounted on a shuttle and arranged to pivot relative to the shuttle, said shuttle being arranged to move the temporary spittoon between the first and second positions; and a printhead servicing element comprising a cap or a wiper arranged to be movable between a non-active position distant from the printhead and an active position adjacent to the printhead;

wherein the movement of the temporary spittoon is linked to that of the servicing element so that the temporary spittoon is arranged to be in the first position when the servicing element is in the non-active position and to be in the second position when the servicing element is in active position.

20. A device according to claim 19, wherein:

said active position of said servicing element corresponds to said first position of said temporary spittoon.

21. An inkjet printhead servicing assembly comprising:

a spittoon arranged to store ink ejected by an inkjet printhead in a spitting operation; and a substantially noncylindrical spitting shelf, rockable in reciprocation along a substantially linear path between:

a first position for directly receiving ink drops ejected by the printhead in a spitting operation, and a second position for pouring the received ink off the shelf into the spittoon.

22. The device of claim 21, wherein:

the shelf is substantially rigid.

23. An inkjet device comprising:

at least one print head arranged to eject ink drops in a spitting operation;

a spittoon arranged to store the ejected ink; and a temporary ink receiver arranged and powered to reciprocate substantially rectilinearly between:

a first position in relatively closer proximity to a nozzle plate of the printhead, to intercept ink with minimal formation of aerosol; and a second position relatively more distant from the nozzle plate to allow capping or wiping of the nozzle plate.

24. An inkjet printhead servicing assembly comprising:

a spitting surface;

a cap assembly;

a reciprocating shuttle arranged to move along a generally rectilinear path between first and second positions and to actuate the spitting surface and the cap assembly;

the servicing assembly being arranged so that:

when the shuttle is in the first position the cap assembly is located distant to a nozzle plate of the printhead and the spitting surface is located in close proximity to the nozzle plate so that ink ejected from the nozzle plate during a spitting routine is ejected onto the spitting surface; and when the shuttle is in the second position the cap assembly substantially caps the nozzle plate and the spitting surface is located in a position such that the ink ejected onto the spitting surface is transferable under gravity to a permanent ink storage container.

25. A method of servicing an inkjet printhead with a servicing assembly; said servicing assembly comprising a spittoon arranged to store ink ejected by said inkjet printhead in a spitting operation, and a generally planar spitting surface; said method comprising the steps of:

locating the spitting surface in a first position relatively closer to the printhead and generally horizontal so that drops ejected by the inkjet printhead in a spitting operation are ejected onto the spitting surface and generally are retained thereon;

translating the spitting surface to a second position relatively more remote from the printhead, allowing clearance for printhead wiping or capping, and at the second position inclining the generally planar spitting surface to discharge the retained drops into the spittoon.

26. A method of servicing an inkjet printhead with a servicing assembly; said servicing assembly comprising a spittoon arranged to store ink ejected by said inkjet printhead in a spitting operation, and a spitting surface; said method comprising the steps of:

locating the spitting surface in a first position such that drops ejected by the inkjet printhead in a spitting operation are ejected onto the spitting surface;

moving the spitting surface along a substantially rectilinear path to a second position such that the ejected drops may be transferred to the spittoon; and capping or wiping the printhead when the spitting surface is in the second position.

* * * * *